United States Patent [19]

Fujishima et al.

[11] Patent Number: 4,556,782

[45] Date of Patent: Dec. 3, 1985

[54] HAND-HELD HAIR DRYER

[75] Inventors: Nobuichi Fujishima, Hikone; Kuniharu Ichikawa, Kyoto, both of Japan

[73] Assignee: Matsushita Electric Works, Ltd., Osaka, Japan

[21] Appl. No.: 531,732

[22] Filed: Sep. 13, 1983

[30] Foreign Application Priority Data

Dec. 10, 1982 [JP] Japan ..... 57-187814[U]
Feb. 17, 1983 [JP] Japan ..... 58-25959

[51] Int. Cl.[4] ..... H05B 1/00; A45D 20/10

[52] U.S. Cl. ..... 219/370; 174/135; 219/366; 219/374; 219/379; 34/96

[58] Field of Search ..... 219/370, 366, 367, 368, 219/369, 371, 373, 374, 379, 380; 34/96–101; 174/135; 242/85.1

[56] References Cited

U.S. PATENT DOCUMENTS

| | | | |
|---|---|---|---|
| 3,132,232 | 5/1964 | Freedman | 34/96 |
| 3,397,463 | 8/1968 | Laing | 219/370 |
| 3,846,047 | 11/1974 | Wade et al. | 219/366 |
| 3,986,272 | 10/1976 | Feierabent | 219/370 |
| 4,370,544 | 1/1983 | Fujishima | 219/370 |

FOREIGN PATENT DOCUMENTS

| | | | |
|---|---|---|---|
| 2528478 | 1/1977 | Fed. Rep. of Germany | 219/370 |
| 52-66060 | 6/1977 | Japan | 219/370 |
| 1550031 | 8/1979 | United Kingdom | 219/370 |

*Primary Examiner*—C. L. Albritton
*Assistant Examiner*—Teresa J. Walberg
*Attorney, Agent, or Firm*—Stevens, Davis, Miller & Mosher

[57] ABSTRACT

A foldable hair dryer of the hand-held type which includes a housing incorporating an electrically operated means for producing a flow of heated air, a hand grip pivotally attached to the housing, and a power cord extending from the housing. The hand grip is rotatable to a operational position where it extends outwardly from the housing, and to a folded position where it is folded on a part of periphery of the housing. Formed along the periphery of the housing is a first groove which cooperates, when the hand grip is in the folded position, with the second groove formed in the hand grip to define a peripheral channel extending across the housing and the folded hand grip. The power cord can be received in the peripheral channel thus formed and be wound up along the entire periphery of the hair dryer when the hand grip is brought in the folded position. The hand grip is shaped to have a cap portion which closes an air discharge outlet when it is in the folded position so as to prohibit the entry of foreign matter therethrough. Means incorporated in the hair dryer for producing a flow of heated air is energized by the operation of a knob which is accessible from the exterior of the housing and is locked in position not to energize the means for producing a flow of heated air until the hand grip is brought in the operational position, thus preventing an accidental flow of heated air blown from the outlet when the hand grip is in the folded position, since such accidental flow would otherwise damage the hand grip and the power cord wound thereon.

7 Claims, 16 Drawing Figures

HAND-HELD HAIR DRYER

BACKGROUND OF THE INVENTION

1. Field of the Invention

This invention relates generally to hair dryers, more particularly to electrical powered hand-held dryer having a foldable hand grip and a power cord extending therefrom to connect it to an electric power source.

2. Description of the Prior Art

In most cases, a hand-held dryer which has electric means for producing a flow of heated air is provided with a power cord extending from a housing. The power cord associated with the dryer may be sometimes a hindrance when the dryer is to be packed or stored and thus annoy a user as in the case of carrying it on a trip. There have been proposed hand-held air dryers which are aimed to overcome the above problem. FIG. 1 shows a typical example of such a dryer which comprises a flat-shaped housing 1 provided with a peripheral groove 2 adapted to receive a wound power cord therein. Although the dryer of such type is designed to be compact in size as well as to provide means for receiving the power cord wound around the periphery of the dryer, it is obviously difficult not to have a hand grip extending outwardly from the housing by the structural necessity of providing the peripheral groove for the wound power cord. This structural limitation of not having the hand grip to be attached to the housing will bring about another problem in handling the dryer, the user has no other way to grasp the housing itself to possibly close the air inlet to outlet by his hand. This results in less amount of the air flow blown off from the outlet, or in the danger of the user getting burnt in the hand if placed closely adjacent to the outlet.

While on the other hand, hand-held dryers with a foldable hand grip are prominent on the market for facilitating the handling and for the purpose of occupying little space when packed, however, these dryers with a foldable hand grip seems to disregard the means for receiving the power cord in such a manner to neatly arrange the power cord when out of use or when packed. Therefore, the power cord is still found to detract from the packing or storing purpose of the hair dryer.

Accordingly, it is most desirable for a hand held hair dryer which is required to occupy little space when packed to have means for receiving the power cord as well to have a foldable hand grip for facilitating the handling of the hair dryer. The present invention has been accomplished to combine the above two requirements for a hand-held dryer and to provide useful features, which will be discussed hereinafter.

SUMMARY OF THE INVENTION

An improved hair dryer of this invention comprises a housing having therein electrically operated means for producing a flow of heated air, an elongated hand grip attached to the housing, and a power cord extending from the housing for supplying the power to the means for producing a flow of heated air. The hand grip is pivotally attached to the housing so as to rotate about a pivot axis between a folded position where it is folded on a part of the periphery of the housing to form therewith one compact body and an operational position where it extends outwardly from the housing to be grasped by the hand of a user. The housing is provided with a first groove extending along the periphery thereof and the hand grip is provided with a second groove extending along the length thereof. Said second groove is cooperative with the first groove when it is brought in the folded position to define a peripheral channel across the housing and the hand grip for receiving the power cord wound up around the hair dryer. As a result of this, the power cord can be received in the peripheral channel in the wound form so as not to annoy a user when the hair dryer is to be packed or stored as is required to carry the dryer on a trip.

Accordingly, it is a primary object of the present invention to provide a hand-held dryer in which the power cord can be wound up and incorporated in the hair dryer not to bother the user when it is to be packed.

In a preferred embodiment of the present invention, the hand grip is shaped to have at opposite side to said second groove a cap portion adapted to cover or close an air discharge outlet when the hand grip is in the folded position such that any foreign matter is prevented from entering through the outlet and from being trapped in the portion near a heating element in the hair dryer.

It is therefore another object of the present invention to provide a hand-held hair dryer which is free from being damaged by the entrance of foreign matter and is safe enough not to discharge heated air toward the user.

Along with the above features, there is also disclosed in the present invention that the hand grip is designed to have therein a hook to retain or arrest the power cord to pass through the hand grip. With this construction, the use can not be annoyed at the dangling power cord in his handling of the hair dryer.

It is a further object of the present invention to provide a hand-held dryer which is easily manipulated in hair styling without being troubled with the power cord.

Further included in the present invention is lock means which is cooperative with the hand grip to restrain the hair dryer from being energized or driven when the hand grip is brought in said second position to cover the air outlet. This feature adds safety to the above structural advantages in that the heated air will not be produced and thus will not damage the hand grip closing the outlet or the power cord extending across the hand grip when it is in the folded position.

Consequently, it is a still further object of the present invention to provide a hand-held dryer which is safe and does not cause heat damage.

These and other objects and features of the present invention will become more apparent with reference to the following description and to the drawings.

DETAILED DESCRIPTION OF THE INVENTION

Figure 1:
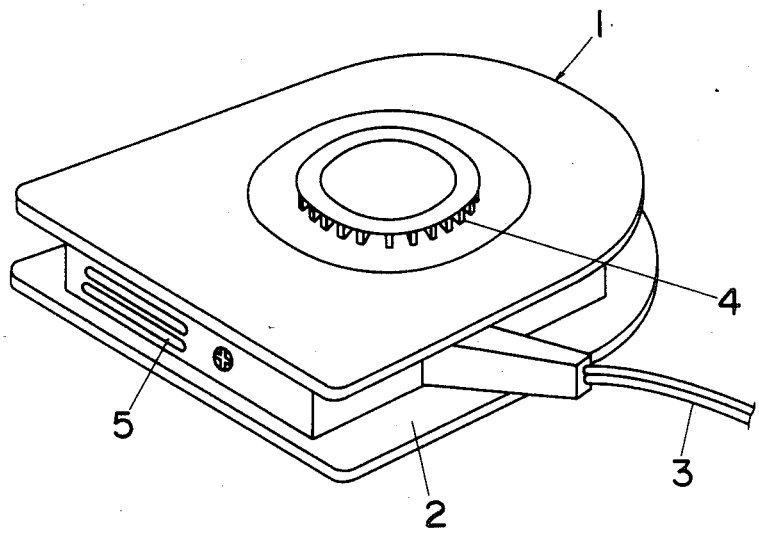
Fig. 1 PRIOR ART
FIG. 1 is a perspective view of a conventional hand held hair dryer having a flat housing which is provided with a peripheral channel for receiving a wound power cord.
Figure 2:
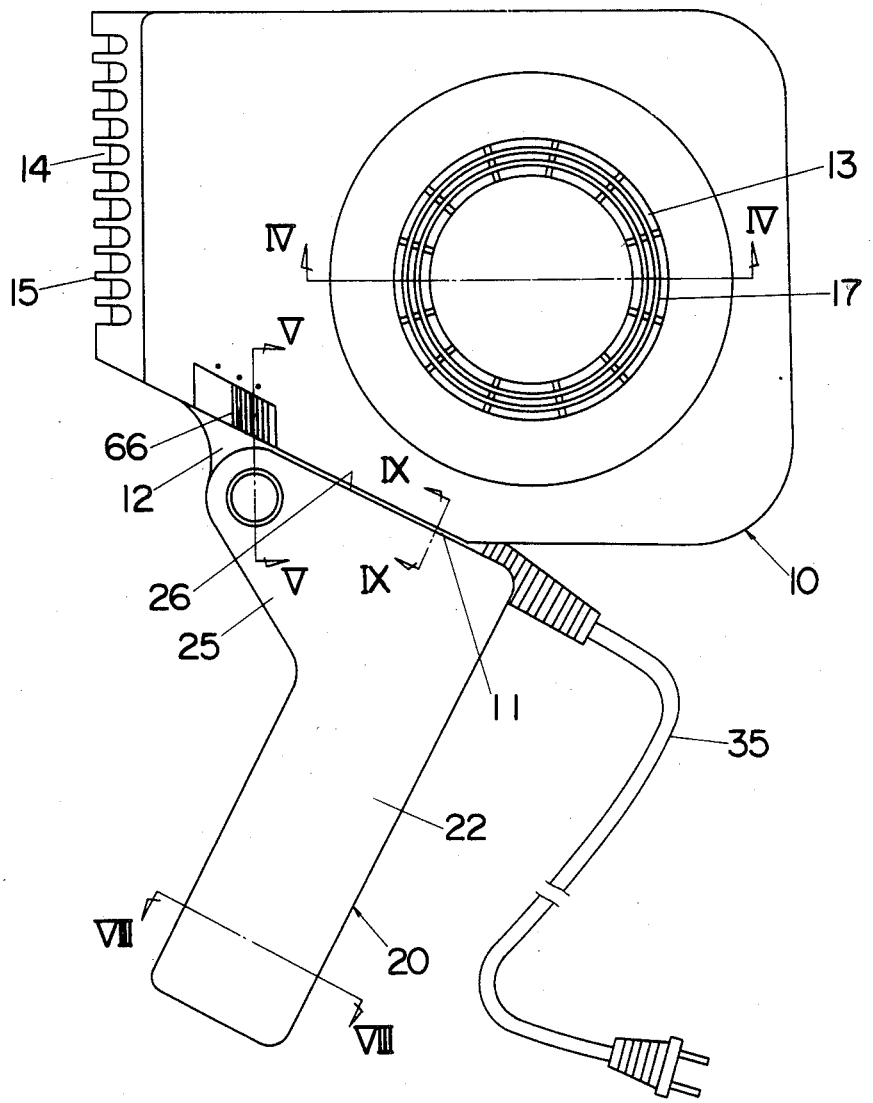
FIG. 2 is an elevation of a hand-held hair dryer in accordance with a preferred embodiment of the present invention.
Figure 3:
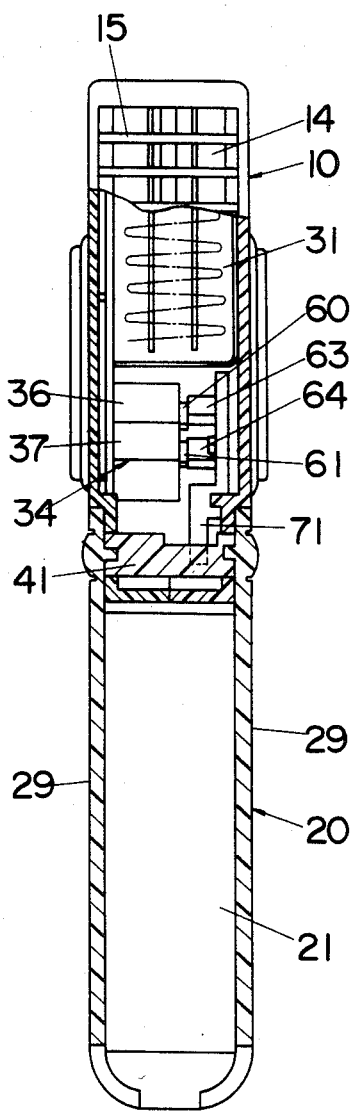
FIG. 3 is a side elevation, partly in cross section and partly schematic, of the hair dryer.
Figure 4:
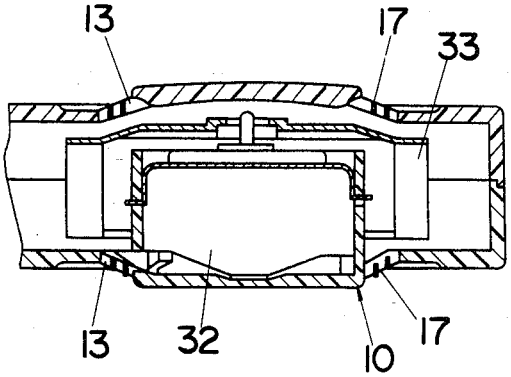
FIG. 4 is a fragmentary cross sectional view, partly schematic, taken along line IV—IV of FIG. 2.
Figure 5:
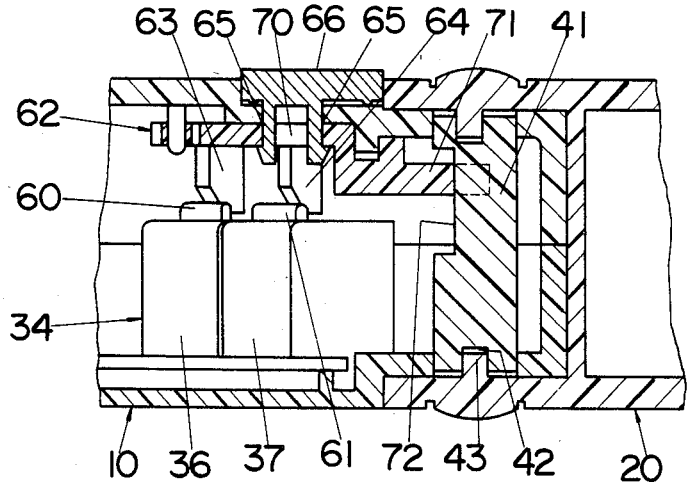
FIG. 5 is a fragmentary sectional view, taken along line V—V of FIG. 2.
Figure 6:
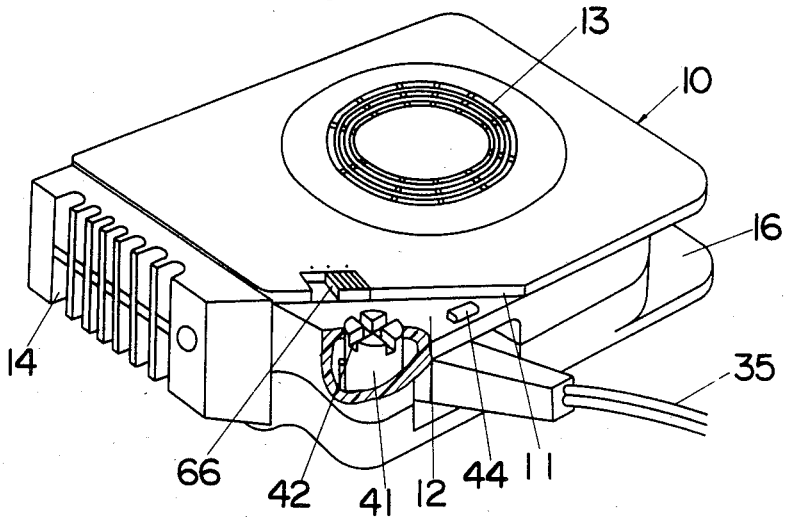
FIG. 6 is a partially exploded perspective view of the hair dryer.
Figure 6:
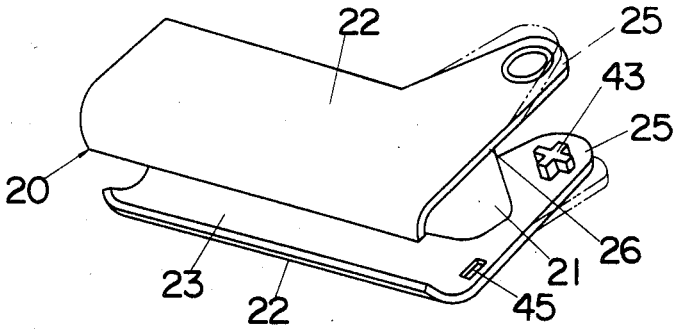
Figure 12:
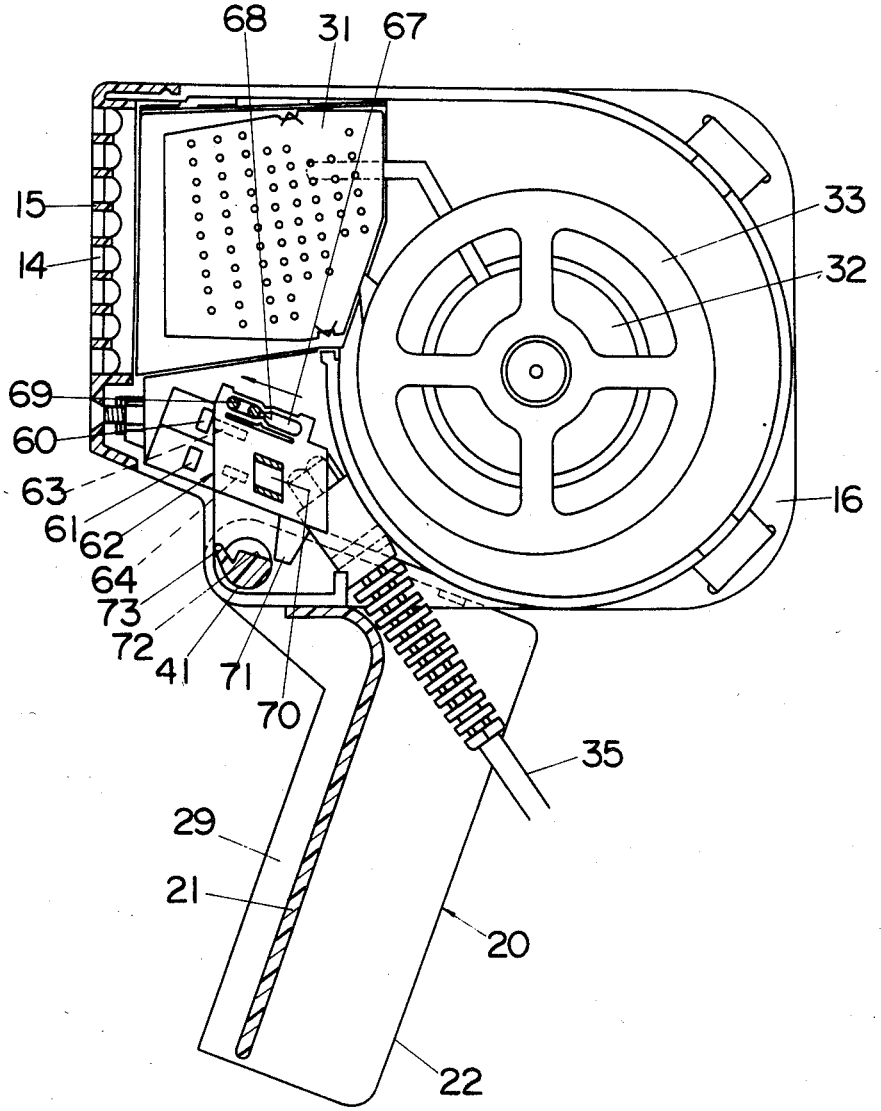
FIG. 12 is a vertical sectional view of the hair dryer when the hand grip is in the operational position.

Referring now to the drawings and particularly to FIG. 2, there is illustrated a hand-held hair dryer embodying the present invention, which includes a housing 10 designed to have a flat-shaped configuration with a pair of generally rectangular sidewalls. An elongated hand grip 20 is pivotally attached to the housing 10 at its one longitudinal end so that it can be brought into two different positions. In one position which is an operational position, it extends outwardly from the bottom of the housing 10 to be readily grasped by the hand of an user, in the other position which is a folded position, it is folded on a part of a periphery of the housing 10. Each sidewall has at its front lower corner an inclined edge 11 extending from the front edge and terminating at the bottom edge thereof to define thereunder a recess 12 with a flat bottom. The recesses in both sidewalls receive respectively a pair of yokes 25 extending continuously from the opposed outer surfaces of the hand grip 20 such that the outer surfaces of the hand grip 20 are flush with the sidewalls. A pair of air inlet 13 with louvers 17 are formed centrally in the respective sidewalls and an air discharge outlet 14 with a guard grill 15 is provided in the front wall of the housing 10. In the rear periphery of the housing 10 is formed a first groove 16 leading from the upper periphery to the lower periphery thereof, as best shown in FIGS. 6 and 12.

Turning to FIGS. 2, 3, 4, and 12, there is shown electrical operated means incorporated in the housing 10 for producing a flow of heated air which comprises an electric heater unit 31 and a fan 33 driven by an electric motor 32, the heater unit 31 and the fan 33 being powered by an ac power source through a power cord 35 extending from the bottom edge portion of the housing 10 and being energized by the operation of an operating knob 66 accessible from the exterior of the housing 10. The means for producing a flow of heated air (hereinafter referred to as heated air producing means) together with the interior of the housing defines a suitable air passage leading from the inlet 13 to the outlet 14. Air entering through the inlet 13 will follows a course within the housing 10 and is then compressed as well as heated to be blown off from the outlet 14 as a flow of heated air. The housing 10 is further provided therein with electric switch means 34 composed of two snap-action switches for connecting the heated air producing means to the power source and disconnecting it therefrom. The electric switch means 34 and the heated air producing means constitute an electric circuit to which the power cord 35, said circuit arrangement and its operation will be mentioned later on.

Figure 8:
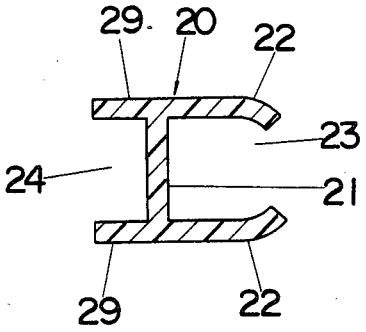
FIG. 8 is a fragmentary cross sectional view of a hand grip attached to the hair dryer, taken along line VIII—VIII of FIG. 2.

Said hand grip 20 is made of suitable synthetic resin to be H-shaped in cross section having a web 21 with a pair of spaced wide flanges 22 on one side and a pair of spaced narrow flanges 29 on the opposite side, as best shown in FIG. 8. Each wide flange 22 and its adjacent narrow flange 29 form a continuous plane, that is, an outer surface of the hand grip 20. The opposed wide flanges 22 define therebetween a second groove 23 extending substantially along the entire length of the hand grip 20 while the opposed narrow flanges 29 define therebetween a cap portion 24 extending likewise substantially along the entire length thereof. Said yokes 25 are integrally projected respectively from the narrow flanges 29 at one longitudinal end of the hand grip 20 at about a right angle with respect to the longitudinal axis of the hand grip 20.

Figure 9:
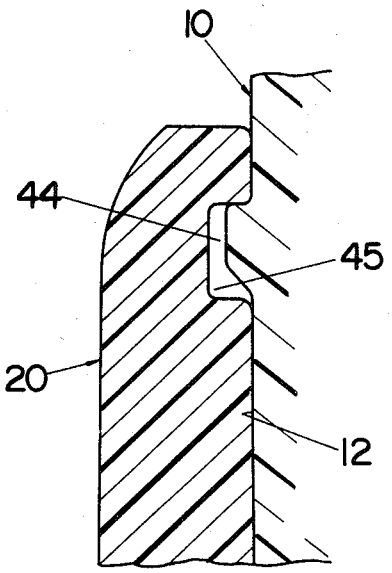
FIG. 9 is a vertical sectional view of a longitudinal end portion of the hand grip when it is in an operational position.

A pivot pin 41 connecting the hand grip 20 to the housing 10 extends through said recesses 12 at the front lower corner thereof and is journaled within the housing 10 with its pivot axis perpendicular to the plane of the sidewall. The pivot pin 41 has at its ends cross-shaped slots 42 to engage respectively with corresponding cross-shaped projections 43 on the inner surfaces of the yokes 25. As illustrated in FIG. 6 by the phantom line, said yokes 25 can flex outwardly due to the inherent resilience of the material from which the hand grip 20 is made in such a way that the projections 43 on the yokes 25 can be readily snapped in the corresponding slots 42. The hand grip 20 thus connected to the housing 10 is kept in engagement with the pivot pin 41 by the self restoring forces of the yokes 25. Consequently, the hand grip 20 can be pivotally attached to the housing 10 so as to rotate about the pivot pin 41 between said two different positions, i.e., the operational position where the hand grip 20 extends outwardly from the housing 10 and the folded position where it is folded to cover the air discharge outlet 14 by said cap portion 23. When the hand grip 20 is brought in the operational position as shown in FIGS. 2 and 12, the outer edges or the rims 26 each of which extends along the yoke 25 and the wide flange 22 are kept in abutting contact respectively with said inclined edges 11 on the housing 10 so as to securely retain the hand grip 20 in position. Projected on the bottom surface of each recess at the portion behind the pivot pin 41 is a stopper 44 which engages with a corresponding notch 45 on the inner surface of each yoke 25 as shown in FIG. 9. This snapping engagement of the stopper 44 with the notch will also causes the hand grip 20 to be securely retained in the operational position until the hand grip 20 is manipulated to be folded for the purpose of packing or storing the hair dryer.

Figure 10:
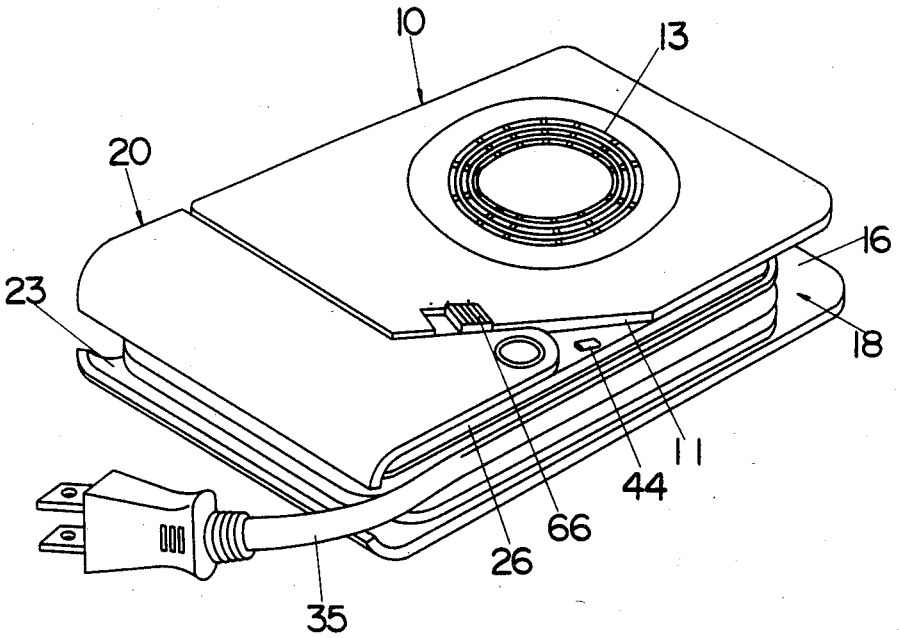
FIG. 10 is a perspective view of the same hair dryer when the hand grip is in a folded position.
Figure 14:
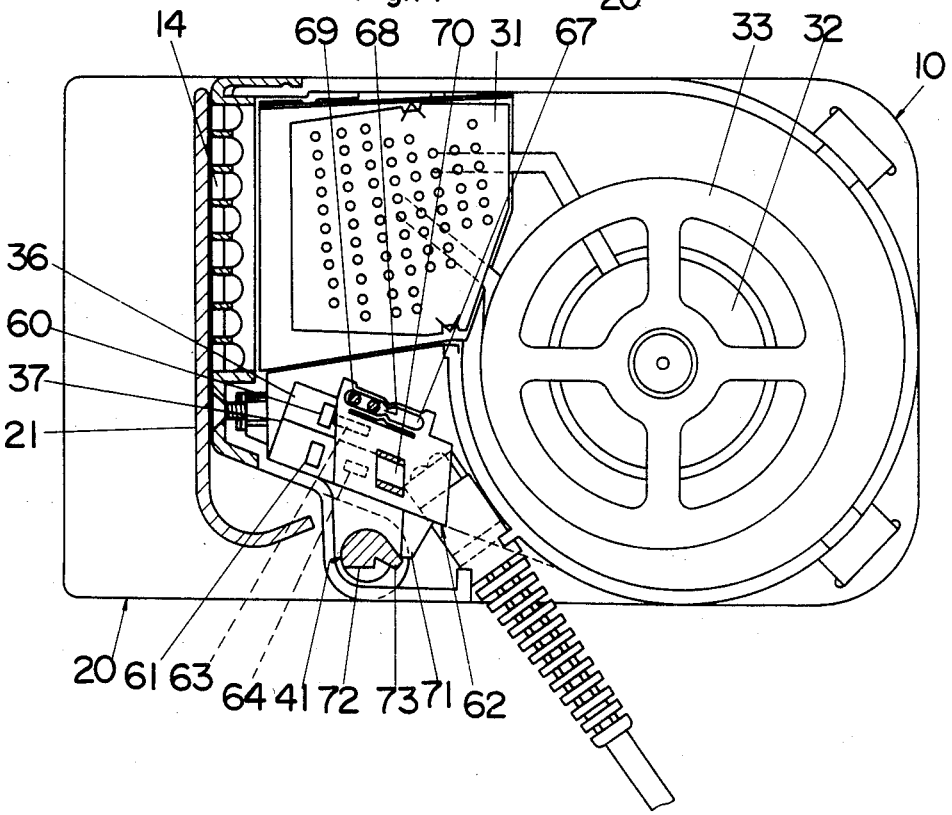
FIG. 14 is a vertical sectional view of the hair dryer with the hand grip brought in the folded position.

When the hand grip 20 is brought in the folded position as shown in FIGS. 10 and 14, the outlet 14 is covered or closed entirely by the cap portion 24 on one side of the hand grip 20 so as to prevent the entry of foreign matter through the outlet 14 at the same time the whole configuration of the hair dryer is neatly arranged to have a generally rectangular configuration which is convenient to be carried. In this folded position, said second groove 23 is exposed outwardly of the housing 10 and is thus positioned to be cooperative with said first groove 16 along the housing 10 to define a peripheral channel 18 which is adapted to receive the power cord wound across the housing 10 and the folded hand grip 20. The first groove 16 and the second groove 23 have approximately the same width to facilitating the operation of winding the power cord 35 around the peripheral channel 18. The hand grip 20 is shaped to be almost equal in thickness to the housing 10 so that the hair dryer can be neatly packed, for example, in a carrying case as well as that it can enjoy good portability.

Figure 15:
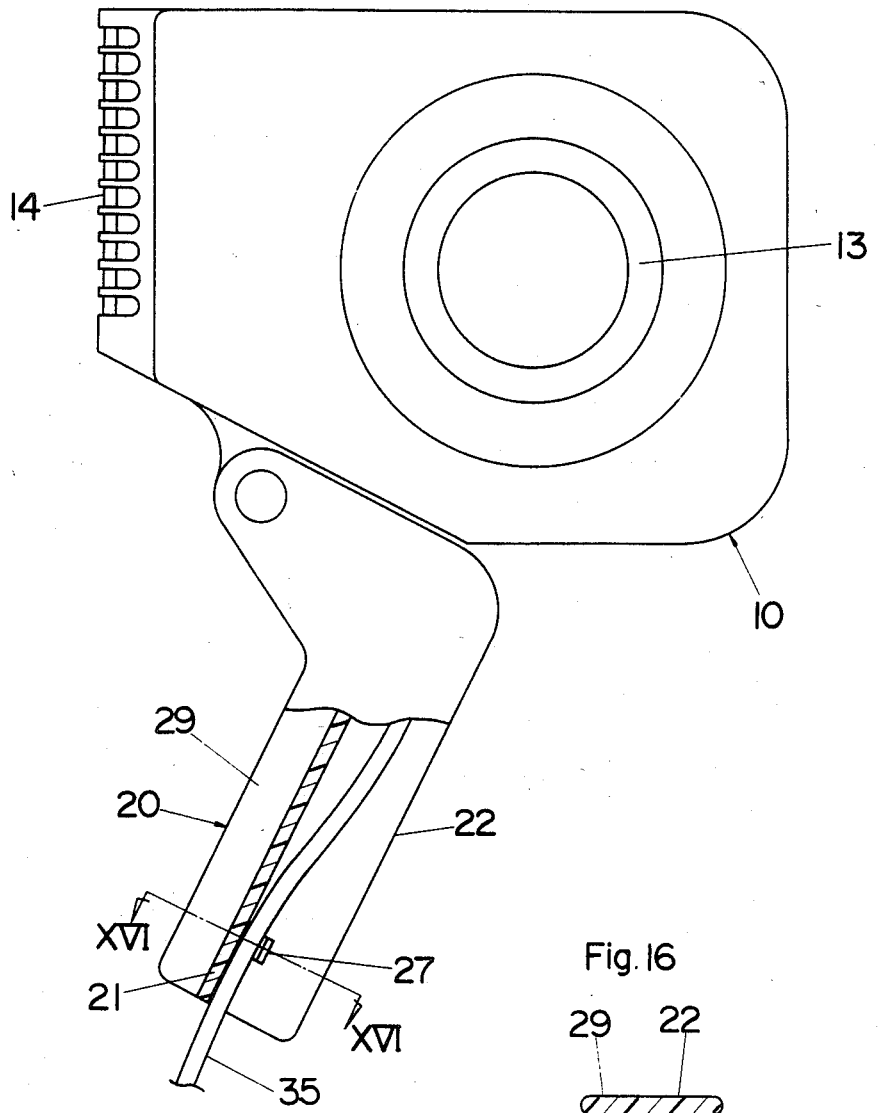
FIG. 15 is an elevation view, partially in section, of a hair dryer in accordance with another embodiment of the present invention.
Figure 16:
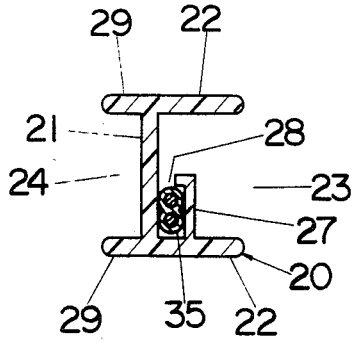
FIG. 16 is a fragmentary cross sectional view, taken along line XVI—XVI of FIG. 15.

Referring to FIGS. 15 and 16 which disclose another preferred embodiment of the present invention, the second groove 23 of the hand grip 20 is provided with a hook 27 disposed near the free end portion of the hand grip 20 to catch the power cord 35. The hook 27 projects from the inner surface of one wide flange to have a L-shaped cross section for clipping the power cord 35 between the web 21 and the hook 27. With this provision of the hook 27 in the hand grip 20, the power cord 35 is held to pass through the hand grip 20 which is grasped by an operator's hand such that the power cord will not bother the operator in handling the hair dryer as opposed to the case when it would be free to dangle about outside of the hand grip to coil round the operator's hand. In addition to the above, the power cord 35 thus held by the hook 27 can be initiated to be wound naturally as the hand grip 20 is moved from the operational position to the folded position for facilitating the winding operation thereof which is required at each time to fold the hand grip 20. The distance between the hook 27 and the web 21 is set to be slightly greater than the width of the power cord 35 so as to allow a slipping movement of the power cord 35 through the hook 27 as well as not to apply a harmful tension force on the power cord 35 by the hook 27. The power cord 35 can be readily inserted between the hook 27 and the web 21 through a constricted opening 28.

Figure 11:
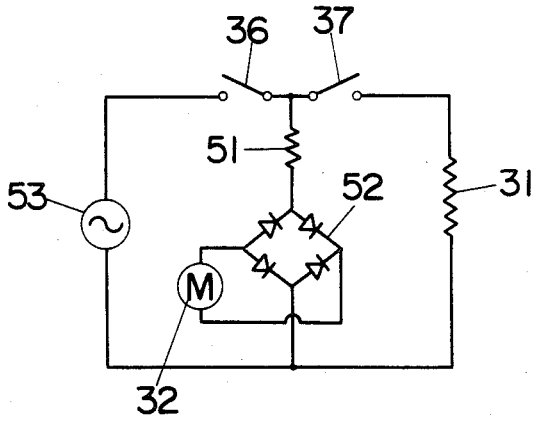
FIG. 11 is a wiring diagram illustrating means incorporated in the hair dryer for producing a flow of heated air.

Turning back to FIG. 11, there is shown a wiring diagram of said circuit including the heated air producing means. The circuit comprises two circuit sections, one is a motor driving circuit section and the other is a heater circuit section. The motor driving circuit section includes a resistor 51, a diode bridge 52 connected in series with resistor 51, the motor 32 which is a dc motor connected across the output ends of the diode bridge 52, and a first switch 36 inserted between the ac power source 53 and the resistor 51, the resistor 51 and the inner resistance of the motor 32 constitute an voltage divider to supply an optimum voltage to the motor 32. The heater circuit section comprises the serial combination of the heater 31 and a second switch 37 which is connected in parallel with the motor driving circuit section. Thus, only the motor 32 is energized to produce a flow of unheated air when the first switch is closed while the second switch is open, and both the motor 3 and the heater 31 are energized to produce a flow of heated air when both switches are closed. It is noted at this time these switch 36 and 37 compose said electric switch means 34 as described hereinbefore.

Said operating knob 66 is a three-position selector knob and includes a carrier plate 62 with a square hole 70 which securely receives legs 65 extending through the sidewall of the housing 10 from the operating knob 66 such that the carrier plate 62 is slidable with the operating knob 66 within the housing 10. The carrier plate 62 has in its upper portion a guide slot 67 defined between a pair of resilient side members with inwardly projecting tips at the middle of their lengths. Extending into the guide slot 67 are a pair of spaced click pins 69 integral with the housing 10 to give a clicking action to the carrier plate 62 as each of the pins pass through the constriction 68 between said tips during the sliding movement of the operating knob 66. The carrier plate 62 is also provided on its back surface with a pair of projections 63 and 64 facing respectively to actuators 60 and 61 on said snap-action switches 36 and 37 fixed within the housing 10. These projections 63 and 64 are arranged to be staggered with respect to the actuators 60 and 61 such that the projection 63 firstly push down the corresponding actuator 60 to energize the motor 32 in the sliding movement of the operating knob 66 from its off-position to the second position and the other projection 64 will push down the corresponding actuator 61 to energize the heater 31 in further sliding movement of the same to the last position. In the last position of the operating knob 66, both actuators 60 and 61 are kept pressed down to energize the motor 32 and the heater 31, producing a flow of heated air.

Figure 7:
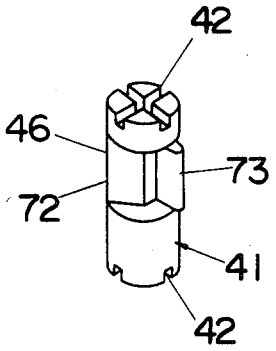
FIG. 7 is a perspective view of the pivot pin employed in the same hair dryer.
Figure 13:
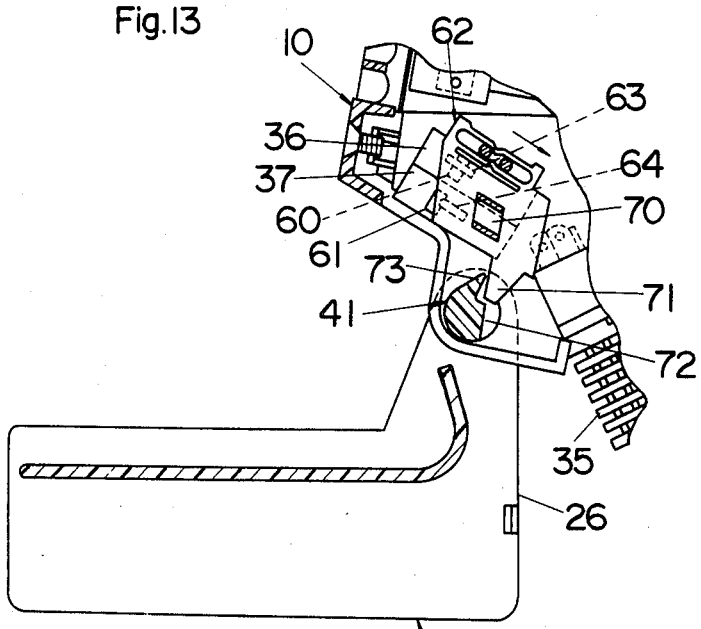
FIG. 13 is a vertical sectional view of a portion of the housing to which the hand grip is attached with the hand grip being in an intermediate position between the operational and the folded positions.

The carrier plate 62 is further provided with a lock lever 71 extending transversely thereof so as to be engageable with said pivot pin 41, which is shaped to have at the middle of its length a cam stud 46 with an cutaway portion 72 as shown in FIG. 7. In the folded position of the hand grip 20 as shown in FIG. 14, the lock lever 71 is brought into engagement with the cam stud 46 to lock the carrier plate 62 or the operating knob 66 in the off-position, preventing the accidental movement of the operating knob 66 in the direction of energizing the motor 32 and/or the heater 31. While, in the operational position of the hand grip 20 as shown in FIG. 12, the lock lever 71 is free to pass through the cutaway portion 72 to unlock the operating knob 66 and make the hair dryer ready for use. A latch 73 extends radially and outwardly from the pivot pin 41 at the portion near the shoulder of said cutaway portion 72 so as to be engageable with said lock lever 71. The latch 73 rotates with the pivot pin 41 to be positioned forwardly of the lock lever 71 far apart therefrom in the operational position of the hand grip 20, allowing the sliding movement of the operating knob 66 from its off-position to last position. But in case of the operating knob 66 left to be in the position other than its off-position, the latch 73 moving backward as the hand grip 20 is folded, as best shown in FIG. 13, will abut against the lock lever 71 and force the carrier plate 62 or the operating knob 66 back to its off-position. With this arrangement, the hair dryer will not operate when the hand grip 20 is folded even if the power cord is unwound and plugged into an ac outlet. Accordingly, abrupt flow of heated air which would damage the hand grip closing the discharge outlet and be dangerous can not be occurred. The above description and particularly the drawings are set forth for purposes of illustration only. It will be understood that many variations and modifications of the embodiments herein described will be obvious to those skilled in the art, and may be carried out without departing from the spirit and scope of the invention.

What is claimed is:

1. A foldable hair dryer of hand-held type which comprises, a housing with a front edge, an adjacent bottom edge and opposed edges defining a housing periphery, said housing further having an air inlet, and an air discharge outlet on said front edge, and a first groove formed along at least a portion of the periphery, electrically operated means incorporated in the housing for producing a flow of heated air, an elongated hand grip pivotally attached to the housing between said front and bottom edges, said hand grip comprising a web extending substantially along the entire length thereof and a pair of flanges extending along both sides of the web to define a second groove an H-shaped cross section, including a second groove on one side of the web, said second groove being of substantially the same width as the first groove, and on the other side of the web defining a cap portion for covering the air discharge outlet;

said hand grip being pivotally attached so as to be rotatable to a folded position where it is folded over said front edge so that said cap portion covers the air discharge outlet and to an operational position where it extends outwardly from the housing to be grasped by a user, and said first groove in the housing cooperating, when the hand grip is brought in the folded position, with the second groove in the hand grip to define a peripheral channel which is adapted to receive therein the power cord wound around the periphery of the hair dryer;

means for pivotally attaching the hand grip to the housing comprising:

an inclined edge extending between said front edge and said bottom edge to define thereunder a recess with a flat bottom;

a pivot pin extending through said recess;

the hand grip having at its end which is pivotally attached to the housing, a pair of yokes extending from the handle, at least one of said yokes having an outer edge;

said yokes being secured to the pivot pin in such a manner that the yoke outer edge abuts the inclined edge so a securely to retain the hand grip in at least one of the extended or folded positions.

2. A foldable hair dryer of hand-held type as set forth in claim 1, wherein said hand grip is provided adjacent its free end portion with a hook to catch the power cord.

3. A foldable hair dryer of hand-held type as set forth in claim 2, wherein said hook is formed in the second groove of the hand grip so as to pass the power cord through that groove.

4. A foldable hair dryer of hand-held type as set forth in claim 1, wherein said housing has a pair of generally rectangular sidewalls defining major surfaces of the housing and shaping it in a flat configuration, and wherein said yokes each has an outer surface continuous with that of the adjacent flanges and is connected to one end of a pivot pin journaled within the housing, each yoke being adapted to fit in a cooperative recess formed in each sidewall at its corner portion such that the outer surface of each yoke is flush with a corresponding sidewall when the hand grip is brought in the operational position and each other surface of the hand grip, including the yoke, is flush with the corresponding sidewall when the hand grip is in the folded position.

5. The hair dryer of claim 1 including electric switch means for energizing and deenergizing said means for producing a flow of heated air, a manually operating knob accessible from the exterior of the housing for actuating said electrical switch means, lock means cooperative with said hand grip for arresting the manually operating knob so as not to actuate the electrical switch when the hand grip is in said folded position and for releasing the knob to be free to actuate the same when it is in said operational position.

6. A foldable hair dryer as set forth in claim 5 wherein said pivot pin is rotatably journaled within the housing to rotate together with the hand grip about its axis, said pivot pin having thereon a cam portion which defines said lock means and is brought into abutting engagement with the operating knob when the hand grip is in the folded position so as to arrest the operating knob in a position of deenergizing the means for producing a flow of heated air.

7. A foldable hair dryer as set forth in claim 6, wherein said operating knob is a sliding selector knob which includes a carrier plate slidable therewith within the housing between an on-position and an off-position, and wherein said pivot pin is provided with a radially extending latch which is engageable with the carrier plate, and wherein said selector switch means comprises at least one switch with a push-buttom actuator which is pressed down to actuate the switch by a projection formed on said carrier plate when it is moved to the on-position, said latch rotating about a pivot axis as the hand grip is moved from the operational position to the folded position to be brought into latching engagement with the carrier plate when it is in on-position in such a way as to force at least one of the carrier plate and the operating knob back to the off-position during the folding operation of the hand grip.

* * * * *